US007399187B1

(12) United States Patent
Chaing et al.

(10) Patent No.: US 7,399,187 B1
(45) Date of Patent: Jul. 15, 2008

(54) I/O CONNECTOR

(75) Inventors: Shu Man Chaing, Tu-Cheng (TW); Mei Chuan Yuan, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/902,212

(22) Filed: Sep. 20, 2007

(51) Int. Cl.
*H01R 12/00* (2006.01)

(52) U.S. Cl. ..... 439/78; 439/701

(58) Field of Classification Search ..... 439/78, 439/79, 80, 81, 82, 83, 567, 598, 701, 751
See application file for complete search history.

(56) References Cited

U.S. PATENT DOCUMENTS 4,676,579 A * 6/1987 Ting ..... 439/825
5,413,491 A * 5/1995 Noschese ..... 439/108
6,053,763 A * 4/2000 Brennan et al. ..... 439/491
6,241,556 B1 * 6/2001 Chih ..... 439/607
6,875,055 B2 * 4/2005 Chu et al. ..... 439/607
6,974,337 B2 * 12/2005 Belopolsky et al. ..... 439/82
7,223,128 B1 * 5/2007 Bogese ..... 439/676

* cited by examiner

*Primary Examiner*—Thanh-Tam T Le
(74) *Attorney, Agent, or Firm*—Rosenberg, Klein & Lee

(57) ABSTRACT

An I/O connector includes a housing, an insulating body and a plurality of terminals. The housing has a recess for receiving the insulating body. The insulating body defines fixing cavities on a bottom surface thereof and fixing grooves on a back surface thereof for receiving the terminals. The terminal has a fixing portion. One end of the fixing portion bends to form a soldering portion and the other end of the fixing portion bends sideward to form a bent portion. The end of the bent portion extends downward and separates into two elastic arms. Free ends of the two elastic arms bend toward two reverse directions respectively and then bend reversely to approach each other again to form two contact portions, whereby an opposite elasticity is generated to provide a firm engagement with a printed circuit board and to prevent transmission from cutting off while being shocked.

5 Claims, 5 Drawing Sheets

I/O CONNECTOR

BACKGROUND OF THE INVENTION

1. Field of the Invention

The present invention generally relates to an I/O connector, and more particularly to an I/O connector having terminals and a printed circuit board engaged with each other firmly.

2. The Related Art

Traditionally, the electronic device such as a mobile phone usually needs to use an I/O connector while charging or transmitting signal. The I/O connector is fixed on a printed circuit board by soldering terminals on the printed circuit board via SMT method, or by way of elasticity compression making terminals against the printed circuit board.

However, plastic components of the I/O connector are apt to change shape as a result of high temperature and high pressure when the terminals are soldered on the printed circuit board. The I/O connector fixed on the printed circuit board by way of elasticity compression of the terminals can overcome the problem. By this way, the I/O connector can't have the terminals and the printed circuit board engaged with each other firmly. The transmission between the terminals and the printed circuit board is easily interrupted after a sudden shock if the engagement provided by elastic compression is not firm.

SUMMARY OF THE INVENTION

An object of the present invention is to provide an I/O connector, which has terminals and a printed circuit board engaged with each other firmly.

The I/O connector includes a housing, an insulating body mating with the housing and a plurality of terminals received in the insulating body. The housing has a top wall, a bottom wall and two sidewalls. A recess is surrounded by the top wall, the bottom wall and the sidewalls for receiving the insulating body. The insulating body received in the recess defines fixing cavities on a bottom surface thereof and fixing grooves on a back surface thereof. The terminal has a fixing portion received in the corresponding fixing cavity. One end of the fixing portion bends to form a soldering portion received in the corresponding fixing groove and the other end of the fixing portion bends sideward to form a bent portion. The end of the bent portion extends downward and separates into two elastic arms. Free ends of the two elastic arms bend toward two reverse directions respectively and then bend reversely to approach each other again to form two contact portions. Free end of each contact portion extends downward. The contact portion locates under the bottom surface of the insulating body.

As described above, when the I/O connector is configured on a printed circuit board, the contact portion of the terminal can provide opposite elasticity so that the terminal can tightly abut against the inside surface of the corresponding hole of the printed circuit board to ensure transmitting signal steadily. At the same time, the opposite elasticity produced by the contact portion of the terminal can prevent transmission from cutting off while being shocked.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
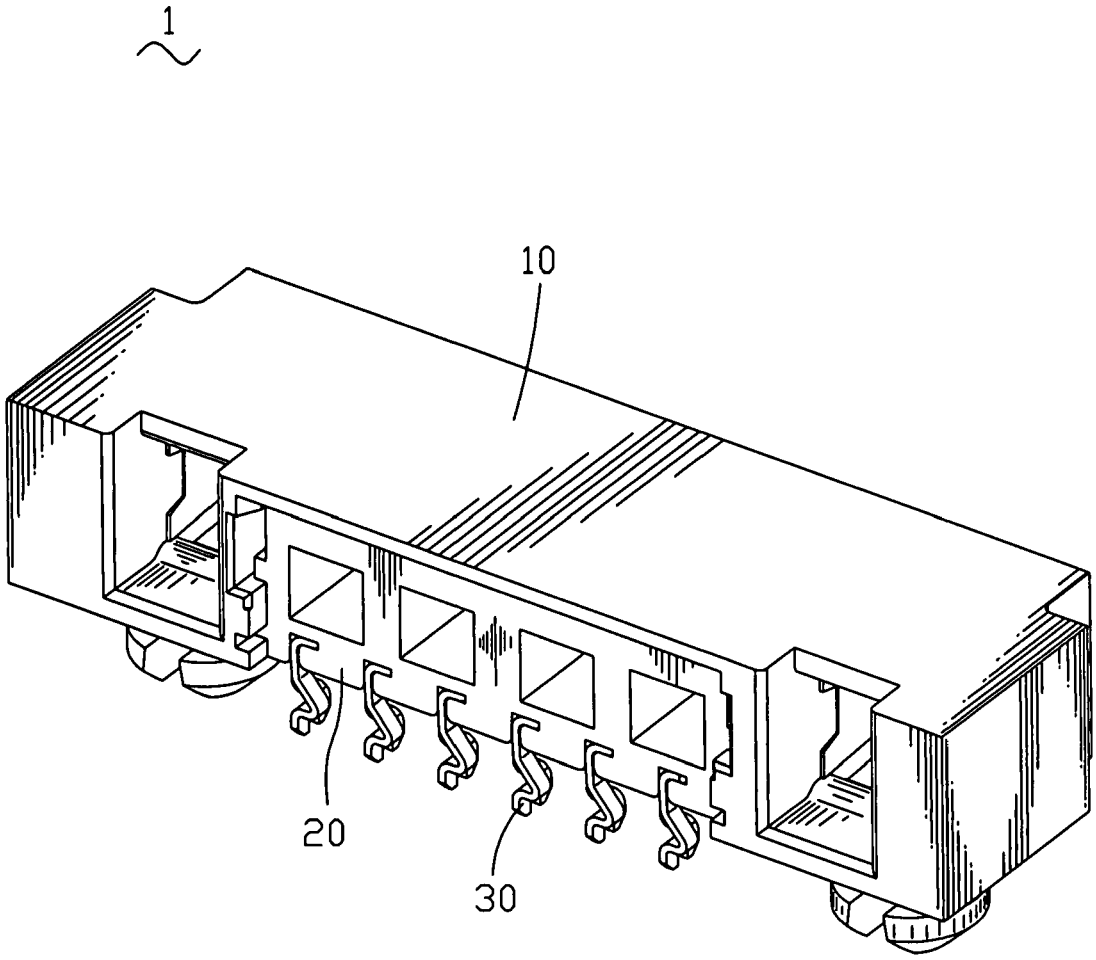
FIG. 1 is a perspective view of an I/O connector in accordance with the present invention.

With reference to FIG. 1, an I/O connector 1 includes a housing 10, an insulating body 20 mating with the housing 10 and a plurality of terminals 30 received in the insulating body 20.

Figure 2:
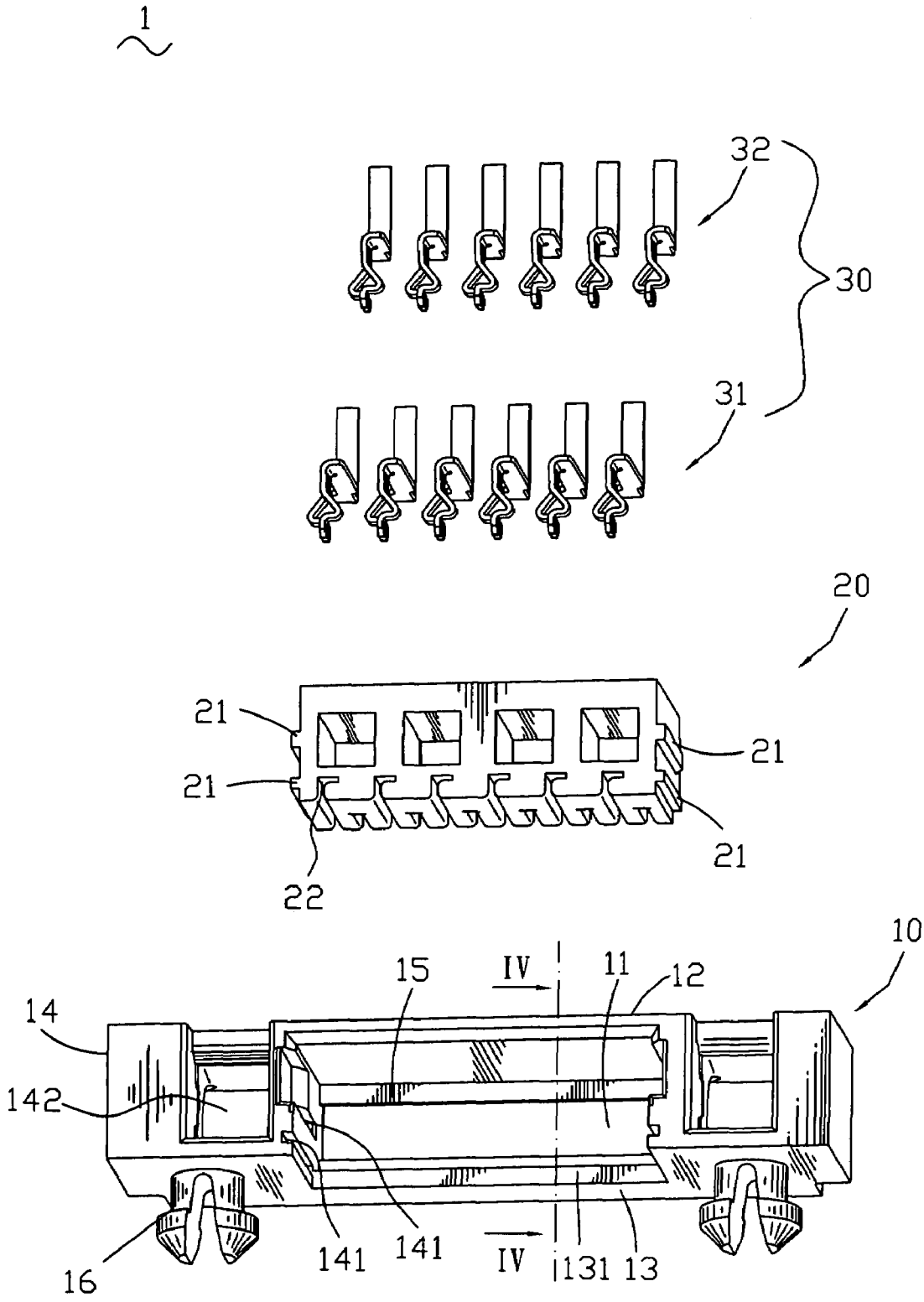
FIG. 2 is an exploded view of the I/O connector.
Figure 3:
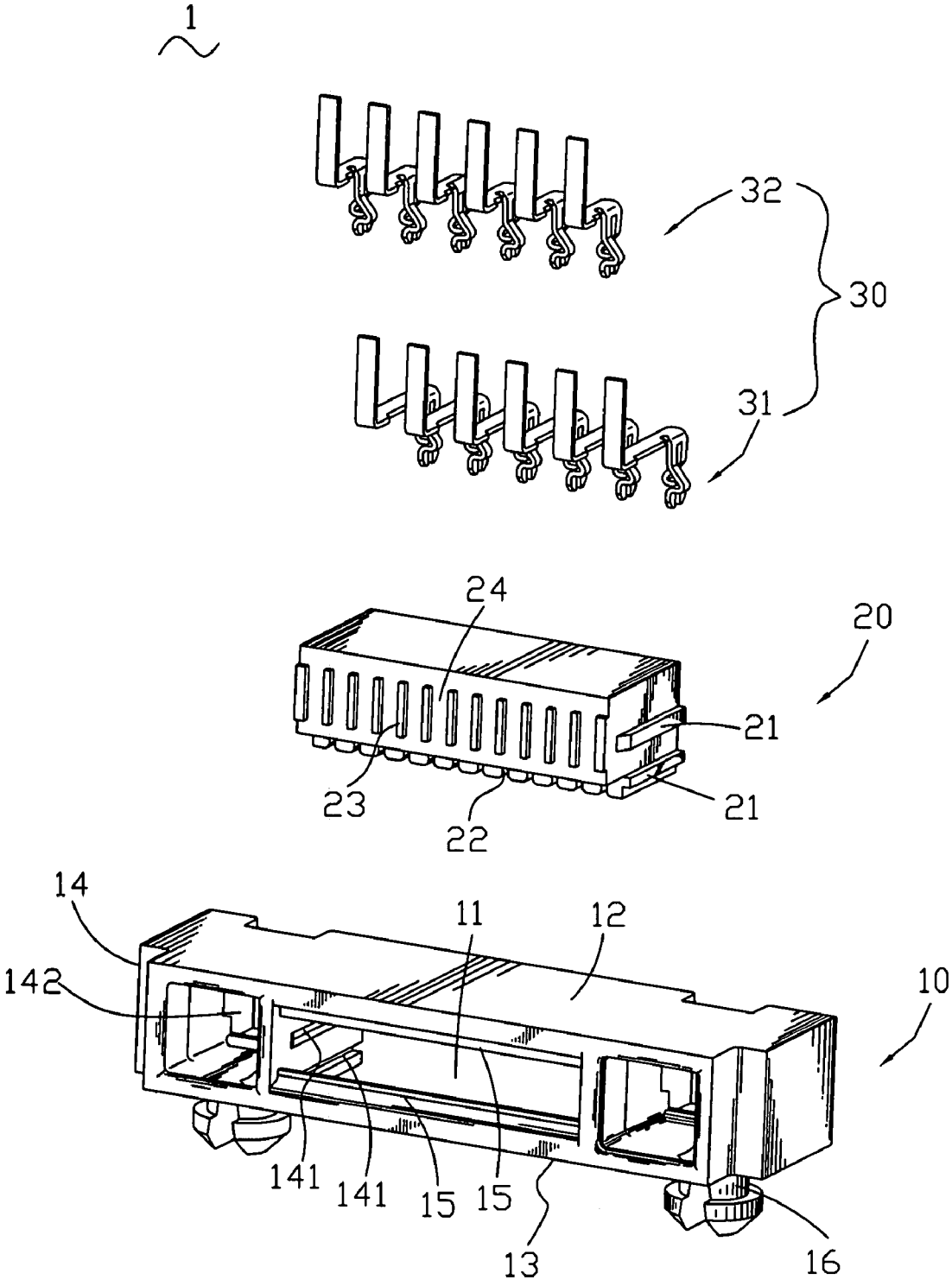
FIG. 3 is another angle exploded view of the I/O connector.
Figure 4:
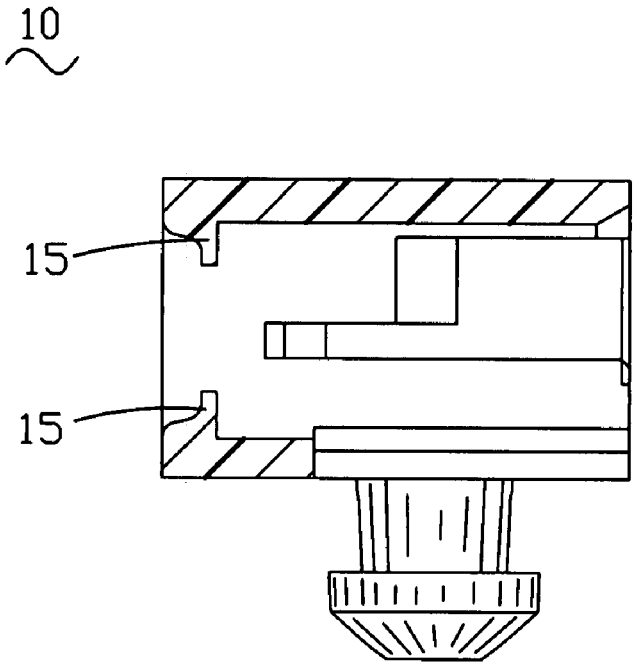
FIG. 4 is a cross-sectional view of the I/O connector along line IV-IV of FIG. 2.

Referring to FIG. 2, FIG. 3 and FIG. 4, the housing 10 is of rectangular shape and has a rectangular recess 11 in the middle thereof for receiving the insulating body 20. Accordingly the rectangular recess 11 defines a top wall 12, a bottom wall 13 and two sidewalls 14. The rear ends of the top wall 12 and the bottom wall 13 extend to the rectangular recess 11 respectively to form a pair of preventing walls 15 facing to each other. The middle of the front of the bottom wall 13 defines an opening 131 in accordance with the rectangular recess 11. Front of an inner surface of the sidewall 14 defines two parallel fixing fillisters 141 communicating with the rectangular recess 11 in a longitudinal direction. Each of the sidewalls 14 defines a perforation 142 passing through an outer surface of the sidewall 14 in a longitudinal direction. The sidewall 14 extends downward to form a cone-shaped locking protrusion 16.

Referring to FIG. 2 and FIG. 3, the insulating body 20 is of rectangular shape corresponding to the rectangular recess 11 of the housing 10. Front of two side surfaces of the insulating body 20 defines two parallel fixing bumps 21 respectively, which are received in the corresponding two parallel fixing fillisters 141 of the housing 10. A bottom surface of the insulating body 20 defines a plurality of fixing cavities 22 arranged at regular intervals along the longwise direction thereof and communicating with the outside respectively. A back surface of the insulating body 20 defines a plurality of ribs 23 arranged at regular intervals at the corresponding place, and accordingly, a plurality of fixing grooves 24 are formed among the ribs 23.

Figure 5:
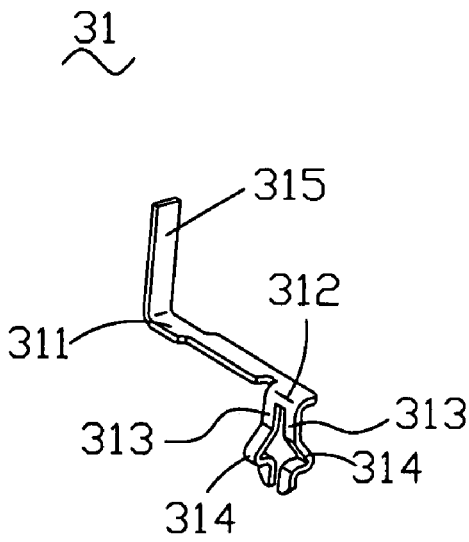
FIG. 5 is a perspective view of first terminals of the I/O connector.
Figure 6:
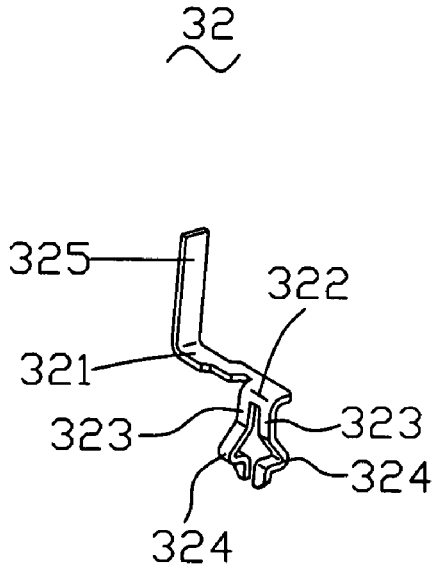
FIG. 6 is a perspective view of second terminals of the I/O connector.

Referring to FIG. 5 and FIG. 6, the terminal 30 includes a plurality of first terminals 31 and second terminals 32. The first terminal 31 and the second terminal 32 have a fixing portion 311, 321 respectively. The fixing portion 311 of the first terminal 31 is longer than the fixing portion 321 of the second terminal 32. One end of the fixing portion 311, 321 bends upward to form a mounting portion 315, 325, the other end of the fixing portion 311, 321 bends sideward to form a bent portion 312, 322. The end of the bent portion 312, 322 extends downward and separates into two elastic arms 313, 323. Free ends of the two elastic arms 313, 323 bend toward two reverse directions respectively and then bend reversely to approach each other again to form two contact portions 314, 324. Free end of each contact portion 314, 324 extends downward a little.

Referring to FIG. 1, FIG. 2 and FIG. 3, in assembly, the fixing portion 311, 321 of the terminal 30 is configured in the corresponding fixing cavity 22 of the insulating body 20, the mounting portion 315, 325 of the terminal 30 is configured in the corresponding fixing groove 24 of the insulating body 20. The elastic arm 313, 323 and the contact portion 314, 324 pass through the fixing cavity 22 and locate under the insulating body 20. The insulating body 20 is received in the rectangular recess 11 of the housing 10, the contact portion 314, 324 passes through the opening 131 of the housing 10 and locates under the housing 10. The fixing bumps 21 are fixed in the corresponding fixing fillisters 141 and the back surface of the insulating body 20 abuts against the preventing walls 15 of the housing 10.

Figure 7:
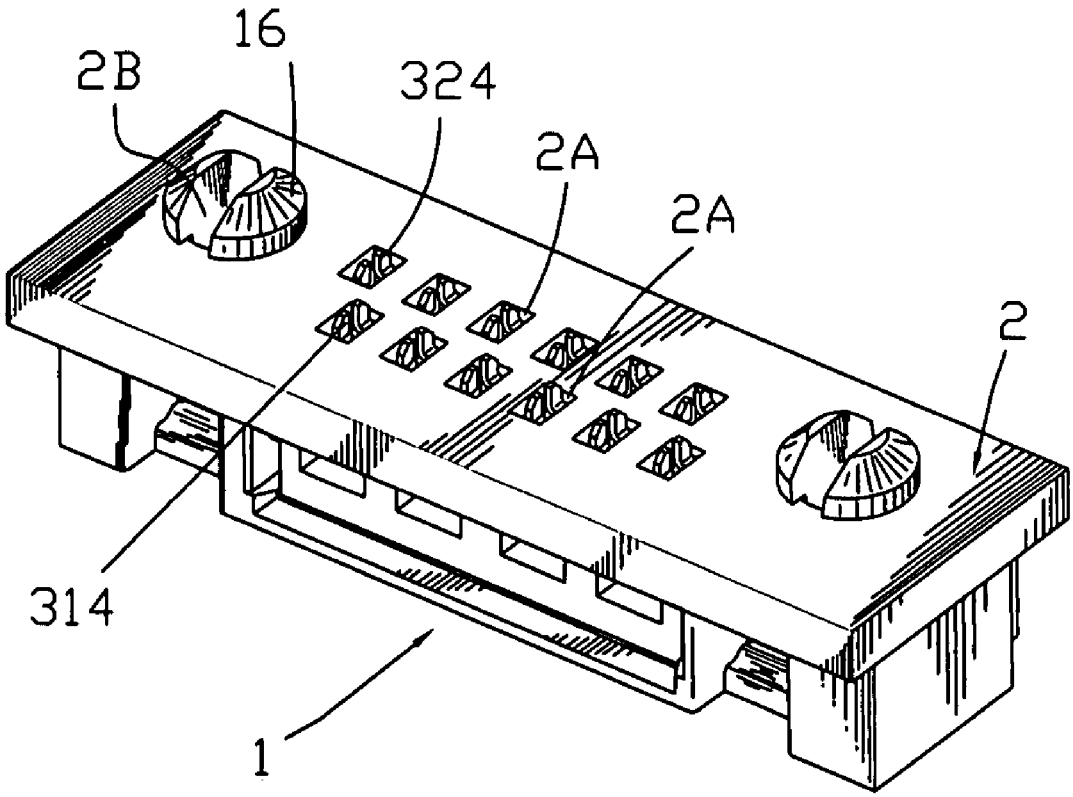
FIG. 7 is a perspective view showing the I/O connector fixed on a printed circuit board.

Referring to FIG. 7, the I/O connector 1 is soldered on a printed circuit board 2, which has a plurality of first holes 2A and two second holes 2B corresponding to the contact portions 314, 324 and the locking protrusions 16. The contact portion 314, 324 inserts into and abuts against an inner surface of the first hole 2A of the printed circuit board 2. The locking protrusion 16 buckles into the second hole 2B to fix the I/O connector 1 on the printed circuit board 2.

As described above, the contact portion 314, 324 of the terminal 30 can provide opposite elasticity so that the terminal 30 can tightly abut against the inside surface of the first hole 2A of the printed circuit board 2 to ensure transmitting signal steadily. At the same time, the opposite elasticity produced by the contact portion 314, 324 of the terminal 30 can prevent transmission from cutting off while being shocked.

What is claimed is:

1. An I/O connector, comprising:

a housing, having a top wall, a bottom wall and two sidewalls, a recess surrounded by the top wall, the bottom wall and the sidewalls;

an insulating body, received in the recess, defining fixing cavities on a bottom surface thereof and fixing grooves on a back surface thereof; and a plurality of terminals, received in the insulating body, each of the terminals having a fixing portion received in the corresponding fixing cavity, one end of the fixing portion bending to form a mounting portion received in the corresponding fixing groove, the other end of the fixing portion bending sideward to form a bent portion, one end of the bent portion extending downward and separating into two elastic arms, free ends of the two elastic arms bending toward two reverse directions respectively and then bending reversely to approach each other again to form two contact portions, each free end of the contact portions extending downward, the contact portions located under the bottom surface of the insulating body and passing through an opening formed in the bottom wall of the housing to insert into corresponding holes of a printed circuit board and abut against inner surfaces thereof.

2. The I/O connector as claimed in claim 1, wherein a front of an inner surface of the sidewall of the housing defines at least a pair of fixing fillisters communicating with the recess in a longitudinal direction, a front of an outer surface of the insulating body defines at least a pair of fixing bumps received in the corresponding fixing fillisters of the housing.

3. The I/O connector as claimed in claim 2, wherein the back surface of the insulating body defines a plurality of ribs arranged at regular intervals at the corresponding place, the fixing grooves formed among the ribs.

4. The I/O connector as claimed in claim 2, wherein the rear ends of the top wall and the bottom wall of the housing extend to the recess respectively to form a pair of preventing walls facing to each other, the back surface of the insulating body abutting against the preventing walls.

5. The I/O connector as claimed in claim 1, wherein the sidewall of the housing extends downward to form a cone-shaped locking protrusion.

* * * * *